US010066642B2

(12) United States Patent
Kawasaki

(10) Patent No.: US 10,066,642 B2
(45) Date of Patent: Sep. 4, 2018

(54) CENTRIFUGAL AIR BLOWER

(71) Applicant: Sanden Corporation, Isesaki-shi, Gunma (JP)

(72) Inventor: Masatoshi Kawasaki, Isesaki (JP)

(73) Assignee: Sanden Holdings Corporation, Isesaki-shi, Gunma (JP)

( * ) Notice: Subject to any disclaimer, the term of this patent is extended or adjusted under 35 U.S.C. 154(b) by 410 days.

(21) Appl. No.: 14/421,105

(22) PCT Filed: Sep. 3, 2013

(86) PCT No.: PCT/JP2013/073716
§ 371 (c)(1),
(2) Date: Feb. 11, 2015

(87) PCT Pub. No.: WO2014/034950
PCT Pub. Date: Mar. 6, 2014

(65) Prior Publication Data

US 2015/0198178 A1 Jul. 16, 2015

(30) Foreign Application Priority Data

Sep. 3, 2012 (JP) ..... 2012-193070

(51) Int. Cl.
*F04D 17/16* (2006.01)
*F04D 29/42* (2006.01)
*F04D 29/66* (2006.01)

(52) U.S. Cl.
CPC ..... *F04D 29/667* (2013.01); *F04D 17/16* (2013.01); *F04D 29/422* (2013.01); *F04D 29/4213* (2013.01); *F04D 29/4226* (2013.01)

(58) Field of Classification Search
CPC .... F04D 17/16; F04D 29/4213; F04D 29/422; F04D 29/4226; F04D 29/667
(Continued)

(56) References Cited

U.S. PATENT DOCUMENTS 353,994 A * 12/1886 Walker et al. ..... F04D 29/422 415/119
2,107,897 A * 2/1938 McMahan ..... F04D 29/422 415/119
(Continued)

FOREIGN PATENT DOCUMENTS

JP S54-009006 A 1/1979
JP 64-063697 A 3/1989
(Continued)

OTHER PUBLICATIONS

The State Intellectual Property Office of People's Republic of China, The First Office Action issued in Application No. CN 201380045566.X, dated Mar. 23, 2016.
(Continued)

*Primary Examiner* — Seth W Mackay-Smith
(74) *Attorney, Agent, or Firm* — Baker Botts L.L.P.

(57) ABSTRACT

There is provided a centrifugal air blower capable of effectively suppressing noise caused by the shapes of a tongue part and a bell mouth formed in a scroll casing, and including: a fan 3 composed of a bottom plate 6 fixed to a rotating shaft, multiple blades 8, and an annular rim 9 provided concentrically with the bottom plate; a scroll casing 4 for housing the fan; a spiral flow passage 19 formed around the fan; and a tongue part 16 for suppressing an inflow of air from the end of winding to the beginning of winding of the spiral flow passage. A portion of the tongue part on the other end side in the axial direction of the rotating shaft is inclined to increase a dimension of overhanging in a counter-rotating direction of the fan toward the other end side in the axial direction of the rotating shaft.

19 Claims, 15 Drawing Sheets

(58) Field of Classification Search
USPC ..... 415/119
See application file for complete search history.

(56) References Cited

U.S. PATENT DOCUMENTS 2,155,631 A * 4/1939 Anderson ..... F04D 17/16 415/119
2,656,095 A * 10/1953 Campbell ..... F04D 29/422 415/118
6,168,378 B1 * 1/2001 Craw ..... F04D 29/441 415/211.2
6,821,088 B2 * 11/2004 Sakai ..... F04D 29/422 415/119
6,935,835 B2 * 8/2005 Della Mora ..... F04D 29/664 415/119
6,953,319 B2 * 10/2005 Sohn ..... F04D 29/4226 415/119
7,144,219 B2 * 12/2006 Hancock ..... F04D 29/422 415/119
8,083,477 B2 * 12/2011 Hwang ..... F04D 25/0613 415/119
8,678,131 B2 * 3/2014 Wiegers ..... F01N 13/18 181/224

FOREIGN PATENT DOCUMENTS

JP S64-060799 A 3/1989
JP 3700217 B2 5/1997
JP 11-090149 A 4/1999
JP 2000064995 A 3/2000
JP 3575986 B2 10/2004
JP 3938252 B2 6/2007
JP 4882620 B2 3/2008
JP 2008-280939 A 11/2008

OTHER PUBLICATIONS

The State Intellectual Property Office of the People's Republic of China, Second Office Action issued in Application No. CN 201380045566.X, dated Nov. 30, 2016.
Japan Patent Office, Notification of Reasons for Refusal issued in Japanese Patent Application No. 2012-193070, dated Jul. 4, 2016.
The State Intellectual Property Office of the People's Republic of China, The Third Office Action issued in Chinese Patent Application No. CN 201380045566.X, dated May 26, 2017.

* cited by examiner

CENTRIFUGAL AIR BLOWER

CROSS-REFERENCE TO RELATED APPLICATIONS

This application is a U.S. National Stage Patent Application under 37 U.S.C. § 371 of International Patent Application No. PCT/JP2013/073716, filed on Sep. 3, 2013, which claims the benefit of Japanese Patent Application No. JP 2012-193070, filed on Sep. 3, 2012, the disclosures of which are incorporated herein by reference in their entirety.

TECHNICAL FIELD

The present invention relates to a centrifugal air blower with a fan having multiple blades between a bottom plate and a rim housed in a scroll casing.

BACKGROUND ART

Conventionally, a centrifugal air blower used, for example, for a vehicle air conditioner has been so constructed that a fan provided with multiple blades (vanes) between a bottom plate fixed to a rotating shaft and an annular rim is housed in a scroll casing to form a spiral flow passage around the fan in this scroll casing. Then, when the fan is rotated by an electric motor, since inside air in a radial direction of the blades is discharged toward the outside in the radial direction, air is sucked in from a suction port formed on one end side in the axial direction of a rotating shaft, and blown out from a blowing outlet formed on a downstream side toward the outside of the scroll casing via a spiral flow passage.

In this case, if a large volume of air flows between the beginning of winding and the end of winding of the spiral flow passage, since the air supply volume will be decreased to cause an increase in specific sound level as well, a tongue part is formed in the scroll casing to suppress the inflow of air from the end of winding to the beginning of winding of the spiral flow passage. Further, a bell mouth curved to introduce air into the fan (impeller) is formed around an inlet (for example, see Patent Document 1).

CITATION LIST

Patent Document

Patent Document 1: Japanese Patent Application Laid-Open No. 2008-280939

SUMMARY OF THE INVENTION

Problems to be Solved by the Invention

However, noise generated when air blown from the fan collides with this tongue part becomes a problem. The reason for that will be described with reference to a schematic diagram of FIG. 8. In view of a velocity distribution of air flowing from the fan, velocity on the electric motor side (the bottom plate side indicated by LWR in FIG. 8) generally becomes higher. Further, since many vortices are contained in the flow of air flowing from the fan, noise is generated when the vortices collide with the tongue part.

On the other hand, in the case of a normal tongue part 100 the front edge of which is parallel to the rotating shaft of the electric motor, stagnant areas exist in a corner 100A of the tongue part 100 on the side of the suction port (indicated by UPR in FIG. 8) and a corner 100B on the side of the electric motor (LWR). Therefore, since shear turbulence due to interference between a flow of air flowing out from the fan and the stagnant areas, and noise due to a secondary flow are produced, there is a problem that noise caused by the tongue part in conjunction with the noise due to the vortices mentioned above increases as a whole.

Noise caused when air flows from the bell mouth into the fan is also of a problem. This will be described with reference to a schematic diagram in FIG. 14. In FIG. 14, a bell mouth 103 is formed around a suction port 102 formed in a scroll casing 101 on one end side of the rotating shaft, and a flow of air flowing in from this bell mouth 103 by the rotation of a fan 104 flows toward a lower portion of a blade 106 (on the electric motor side) and is concentrated thereon.

On the other hand, in an upper portion of the blade 106, there is little flow into the blade 106 (the suction port side) due to separation at the front edge of the bell mouth 103, becoming a stagnant state (FIG. 14). Therefore, the flow of air concentrated on the lower portion of the blade 106 locally has a high flow-rate distribution. Then, in the case of this kind of centrifugal air blower, noise increases in proportion to the sixth power of the flow rate of air (Lighthill's theory).

The present invention has been made to solve such conventional technical problems, and it is an object thereof to provide a centrifugal air blower capable of effectively suppressing noise caused by the shapes of a tongue part and a bell mouth formed in a scroll casing.

Means for Solving the Problems

In order to solve the above problems, a centrifugal air blower of an invention of claim 1 is characterized by including: a fan composed of a bottom plate fixed to a rotating shaft, multiple blades whose bases are fixed to the outer circumference of this bottom plate, and an annular rim provided concentrically with the bottom plate to couple distal ends of the blades; a scroll casing for housing this fan and having a suction port on one end side in an axial direction of the rotating shaft; a spiral flow passage formed around the fan in this scroll casing; and a tongue part for suppressing an inflow of air from the end of winding to the beginning of winding of this spiral flow passage, wherein a portion of the tongue part on the other end side in the axial direction of the rotating shaft is inclined to increase a dimension of overhanging in a counter-rotating direction of the fan toward the other end side in the axial direction of the rotating shaft.

The centrifugal air blower of an invention of claim 2 is based on the above invention, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting overhanging is denoted by Z1, $0.1 \leq Z1/H \leq 0.4$.

The centrifugal air blower of an invention of claim 3 is based on the above invention, characterized in that $Z1/H=0.2$.

The centrifugal air blower of an invention of claim 4 is based on each of the above inventions, characterized in that a portion of the tongue part on one end side in the axial direction of the rotating shaft is also inclined to increase the dimension of overhanging in the counter-rotating direction of the fan toward the one end side in the axial direction of the rotating shaft.

The centrifugal air blower of an invention of claim 5 is based on the above invention, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting overhanging on one end side of the tongue part in the axial direction of the rotating shaft is denoted by Z2, $0.4 \leq Z2/H \leq 0.9$.

The centrifugal air blower of an invention of claim 6 is based on the above invention, characterized in that $Z2/H=0.6$.

The centrifugal air blower of an invention of claim 7 is based on each of the above inventions, characterized in that corners of the ends of the tongue part and the points of starting overhanging are curved smoothly.

The centrifugal air blower of an invention of claim 8 is based on each of the above inventions, characterized in that an upright wall is formed around the suction port in the scroll casing, and a surface of the upright wall on the side of the suction port is curved in a bell mouth shape, and when a dimension from an axial center of the rotating shaft to inner ends of the blades is denoted by Rf1, a dimension from the axial center of the rotating shaft to a front edge of the surface of the upright wall on the side of the suction port is denoted by R1, and a dimension from the axial center of the rotating shaft to an inner edge of the surface of the upright wall on the side of the suction port is denoted by R2, $0.95 \leq R1/Rf1 \leq 1.05$, and $0.94 \leq R2/R1 \leq 1$.

A centrifugal air blower of an invention of claim 9 is characterized by including: a fan composed of a bottom plate fixed to a rotating shaft, multiple blades whose bases are fixed to the outer circumference of this bottom plate, and an annular rim provided concentrically with the bottom plate to couple distal ends of the blades; a scroll casing for housing this fan and having a suction port on one end side in an axial direction of the rotating shaft; and a spiral flow passage formed around the fan in this scroll casing, wherein an upright wall is formed around the suction port in the scroll casing, and a surface of the upright wall on the side of the suction port is curved in a bell mouth shape, and when a dimension from an axial center of the rotating shaft to inner ends of the blades is denoted by Rf1, a dimension from the axial center of the rotating shaft to a front edge of the surface of the upright wall on the side of the suction port is denoted by R1, and a dimension from the axial center of the rotating shaft to an inner edge of the surface of the upright wall on the side of the suction port is denoted by R2, $0.95 \leq R1/Rf1 \leq 1.05$, and $0.94 \leq R2/R1 \leq 1$.

The centrifugal air blower of an invention of claim 10 is based on the invention of claim 8 or claim 9, characterized in that $R1/Rf1=1$ and $R2/R1=1$.

Advantageous Effect of the Invention

According to the invention of claim 1, in the centrifugal air blower including: the fan composed of the bottom plate fixed to the rotating shaft, multiple blades whose bases are fixed to the outer circumference of this bottom plate, and the annular rim provided concentrically with the bottom plate to couple the distal ends of the blades; the scroll casing for housing this fan and having the suction port on one end side in the axial direction of the rotating shaft; the spiral flow passage formed around the fan in this scroll casing; and the tongue part for suppressing an inflow of air from the end of winding to the beginning of winding of this spiral flow passage, since the portion of the tongue part on the other end side in the axial direction of the rotating shaft is inclined to increase the dimension of overhanging in the counter-rotating direction of the fan toward the other end side in the axial direction of the rotating shaft, a stagnant area caused in a corner of the tongue part on the other end side in the axial direction of the rotating shaft disappears, and this can reduce shear turbulence caused by the stagnant area and noise due to a secondary flow.

In this case, as in the invention of claim 2, if $0.1 \leq Z1/H \leq 0.4$ where the dimension of the tongue part in the axial direction of the rotating shaft is denoted by H, and the dimension in the axial direction of the rotating shaft from the end of the tongue part on the other end side in the axial direction of the rotating shaft to the point of starting overhanging is denoted by Z1, noise can be reduced effectively, and as in the invention of claim 3, if $Z1/H=0.2$, noise can be reduced more effectively.

Further, as in the invention of claim 4, if the portion of the tongue part on one end side in the axial direction of the rotating shaft is also inclined to increase the dimension of overhanging in the counter-rotating direction of the fan toward the one end side in the axial direction of the rotating shaft, a stagnant area caused in a corner of the tongue part on the one end side in the axial direction of the rotating shaft also disappear, and a further noise reduction can be achieved.

In this case, as in the invention of claim 5, if $0.4 \leq Z2/H \leq 0.9$ where the dimension of the tongue part in the axial direction of the rotating shaft is denoted by H, and dimension in the axial direction of the rotating shaft from the end of the tongue part on the other end side in the axial direction of the rotating shaft to the point of starting overhanging on one end side of the tongue part in the axial direction of the rotating shaft is denoted by Z2, noise can be reduced more effectively, and as in the invention of claim 6, if $Z2/H=0.6$, the most effective noise reduction can be achieved.

Further, as in the invention of claim 7, if the corners of the ends of the tongue part and the points of starting overhanging are curved smoothly, a further noise reduction can be expected.

Further, according to the inventions of claim 8 and claim 9, since the upright wall is formed around the suction port in the scroll casing, the surface of the upright wall on the side of the suction port is curved in a bell mouth shape, and $0.95 \leq R1/Rf1 \leq 1.05$ and $0.94 \leq R2/R1 \leq 1$, where the dimension from the axial center of the rotating shaft to the inner ends of the blades is denoted by Rf1, the dimension from the axial center of the rotating shaft to the front edge of the surface of the upright wall on the side of the suction port is denoted by R1, and the dimension from the axial center of the rotating shaft to the inner edge of the surface of the upright wall on the side of the suction port is denoted by R2, air flowing in from the suction port by the rotation of the fan flows along the bell mouth shaped surface of the upright wall on the side of the suction port by the Coanda effect to allow easy flowing into the blades on the one end side in the axial direction of the rotating shaft.

This eliminates the concentration of the inflow of air on the other end side of the blades in the axial direction of the rotating shaft, and the flow rate of air is made uniform between respective blades in the axial direction of the rotating shaft of the blades. Thus, since locally high velocities are eliminated, noise is reduced.

If R1/Rf1 increases, noise will be reduced, but the operation efficiency of the centrifugal air blower is reduced.

However, as in the invention of claim 10, if R1/Rf1=1 and R2/R1=1, the operation efficiency can also be maintained in a preferable state.

MODE FOR CARRYING OUT THE INVENTION

Figure 1:
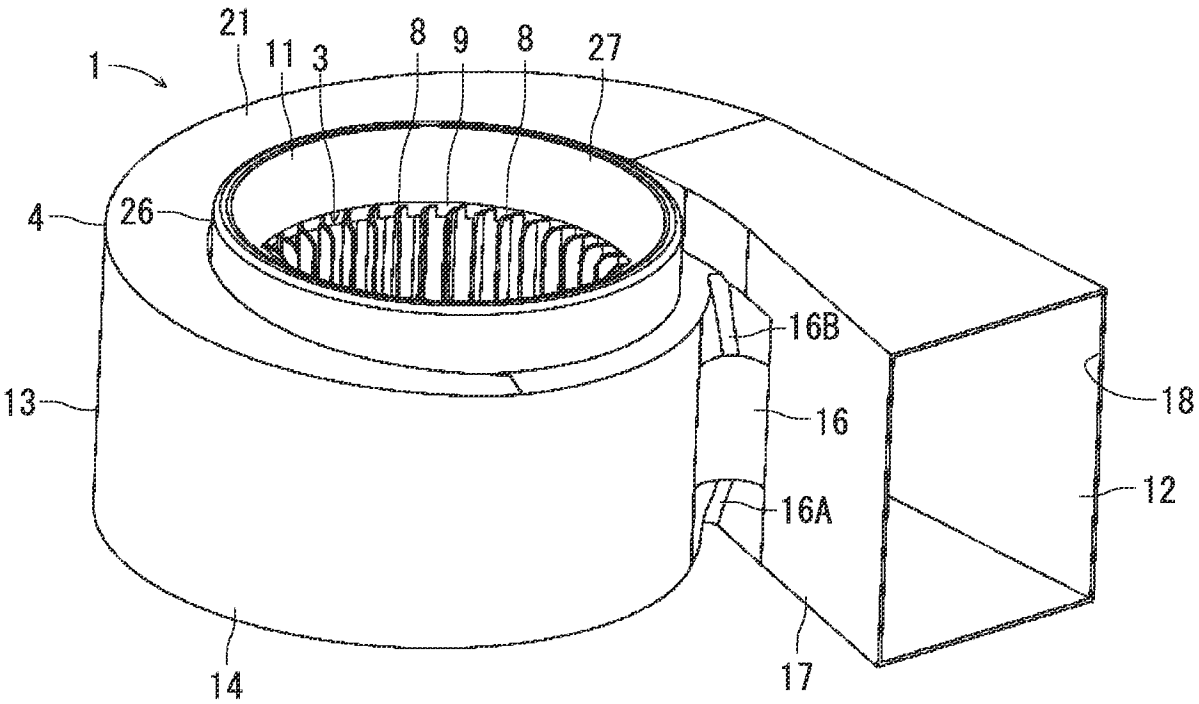
FIG. 1 It is a perspective view of a centrifugal air blower to which the present invention is applied.

An embodiment of the present invention will be described in detail below based on the accompanying drawings. A centrifugal air blower 1 of the embodiment is used in a blowing unit for a vehicle air conditioner, and placed between an inside/outside air changeover damper and a heat exchanger (evaporator), not shown.

In FIG. 1 to FIG. 4, the centrifugal air blower 1 is made up of an electric motor 2 as drive means, a cylindrical fan 3 driven by this electric motor 2 to rotate, and a scroll casing 4. The fan 3 has a bottom plate 6, and a conical part 6A having a nearly cone shape bulging in the axial direction of the fan 3 is formed at the center of the bottom plate 6. A boss part 6B is formed at the center of this conical part 6A, and this boss part 6B is fitted with a rotating shaft 7 of the electric motor 2.

The outer circumference of the bottom plate 6 is formed into a flange shape, and base ends of multiple blades (vanes) 8 are fixed on this outer circumference. These blades 8 are arranged concentrically around the rotating shaft 7 of the electric motor 2 as the center. In this embodiment, each blade 8 extends in parallel to the rotating shaft 7 of the electric motor 2. A predetermined interval is secured between these blades 8, and the distal ends of the blades 8 are coupled by an annular rim 9 provided concentrically with the bottom plate 6.

Then, this fan 3 is housed in the above-mentioned scroll casing 4 made, for example, of hard resin, and the scroll casing 4 forms part of a duct of the blowing unit mentioned above. In other words, the scroll casing 4 has a suction port 11, a blowing outlet 12, and an internal flow passage, and the fan 3 is inserted in this internal flow passage.

Figure 2:
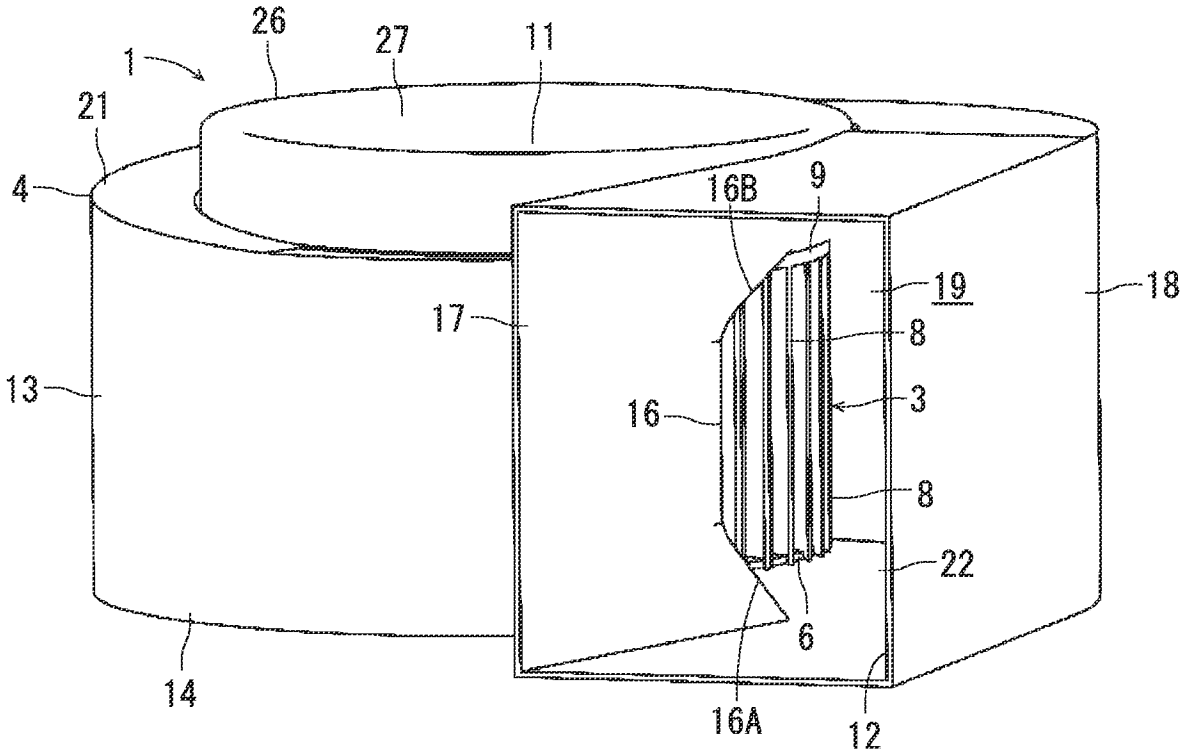
FIG. 2 It is a side view of the centrifugal air blower in FIG. 1.
Figure 4:
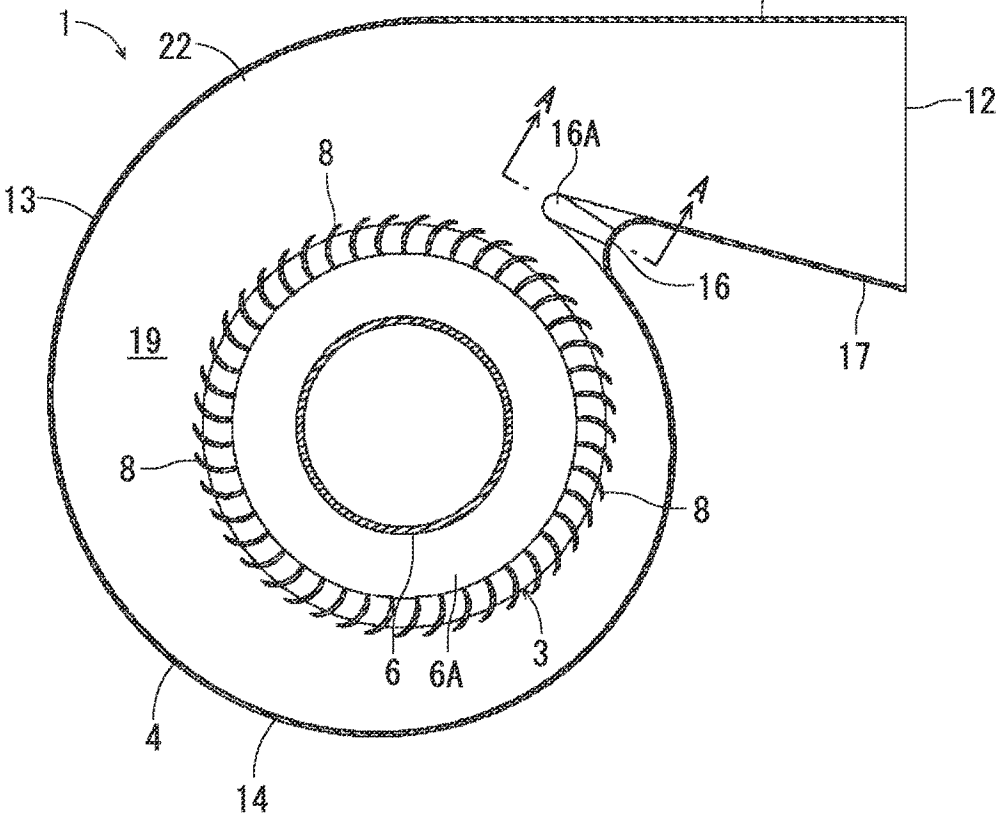
FIG. 4 It is a plan sectional view of the centrifugal air blower in FIG. 1.

The scroll casing 4 has an outer circumferential wall 13 located in a radial direction of the fan 3, and the blowing outlet 12 is open at the end of this outer circumferential wall 13. As shown in FIG. 1, FIG. 2, and FIG. 4, the outer circumferential wall 13 includes a scroll wall section 14 extending in a predetermined spiral shape, and this scroll wall section 14 is so curved that distance in the radial direction from the center of the rotating shaft 7 (the center of the fan 3) will be gradually extended as the angle from the beginning of winding of the spiral to a rotational direction of the fan 3 increases.

The outer circumferential wall 13 further includes a tongue part 16 located at the beginning of winding of the spiral, a planar section 17 continuous with the outer side of this tongue part 16, and a tangential section 18 continuous with the end of winding of the spiral, and the blowing outlet 12 mentioned above is formed between this tangential section 18 and the edge of the planar section 17. The outer circumferential wall 13 defines a spiral flow passage 19 extending in a spiral shape around the fan 3, and this spiral flow passage 19 forms part of the internal flow passage of the scroll casing 4.

The distance between the outer circumferential wall 13 and the fan 3 in the radial direction becomes the shortest at the tongue part 16, and the tongue part 16 is located at the upstream end of the spiral flow passage 19 to play a role in suppressing the inflow of air from the end of winding to the beginning of winding of the spiral flow passage 19. The details of this tongue part 16 will be described later. Then, the blowing outlet 12 mentioned above is located at the downstream end of the end of winding of this spiral flow passage 19.

Figure 3:
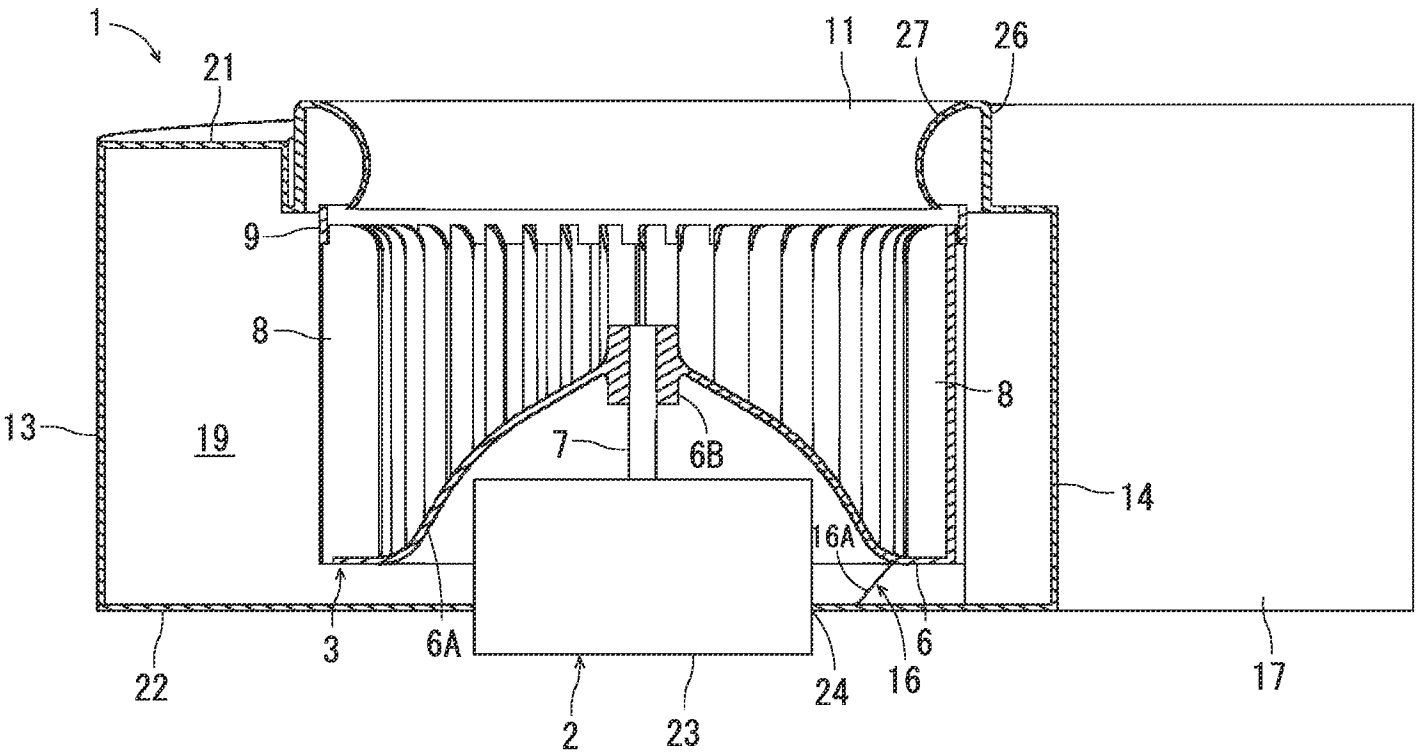
FIG. 3 It is a longitudinal sectional side view of the centrifugal air blower in FIG. 1.

Further, as shown in FIG. 1 to FIG. 3, the scroll casing 4 includes a first end wall 21 located on one end side (at a distal end side) in the axial direction of the rotating shaft 7, and a second end wall 22 located at the other end (on the side of the electric motor 2) in the axial direction of the rotating shaft 7, and the outer circumferential wall 13 extends between these first end wall 21 and second end wall 22 to form the above-mentioned spiral flow passage 19 together with these end walls.

The second end wall 22 on the side of the electric motor 2 is a wall parallel to a plane perpendicular to the axis of the fan 3 (the axial direction of the rotating shaft 7) and located near the bottom plate 6 of the fan 3 as seen from the direction of the axis of the fan 3. A motor mounting hole 24 in which a body 23 of the electric motor 2 is fitted is formed in the second end wall 22. A wall of the second end wall 22 surrounding this motor mounting hole 24 faces the bottom plate 6 of the fan 3, and a wall located on the downstream side of the spiral flow passage 19 continuous with the second end wall 22 extends between the tangential section 18 and the planar section 17.

On the other hand, the suction port 11 mentioned above is formed in the first end wall 21 located on one end side in the axial direction of the rotating shaft 7, and this suction port 11 is located concentrically with the fan 3. An upright wall 26 shaped to stand substantially vertically from the first end wall 21 in a direction of separating from the fan 3 (the axial direction of the rotating shaft 7) and then to be folded back to the side of the suction port 11 is formed around this suction port 11, and the surface of this upright wall 26 on the side of the suction port 11 is curved in a bell-mouth shape. This curved portion is called a bell mouth 27 below. Then, the suction port 11 is formed inside this bell mouth 27, and the inner diameter is set a little smaller than the inner diameter of the rim 9. The details of this bell mouth 27 will also be described later.

As shown in FIG. 1 to FIG. 3, the height of the first end wall 21 in the axial direction of the rotating shaft 7 (distance from the second end wall 22) is inclined at a predetermined angle to increase gradually from the beginning of winding of the spiral flow passage 19 toward the blowing outlet 12. Thus, the spiral flow passage 19 is so formed that the flow passage cross-section area will increase gradually from the upstream (the beginning of winding) toward the downstream (the end of winding).

Then, when power is supplied to the electric motor 2 of the centrifugal air blower 1, the electric motor 2 drives the fan 3 to rotate clockwise in FIG. 4. When the fan 3 is driven to rotate the blades 8, the blades 8 pushes air in a clearance defined between respective blades 8 out of the radial direction. This leads to the generation of an airflow from the inside of the radial direction of the fan 3 toward the outside of the radial direction through the clearance. Along with the generation of this airflow, air flows into the scroll casing 4 via the bell mouth 27 of the suction port 11, and this inflow of air flows out of the scroll casing 4 through the clearance between the blades 8 of the fan 3, the spiral flow passage 19, and the blowing outlet 12.

At this time, since the tongue part 16 exists at the beginning of winding of the spiral flow passage 19 and the distance between the outer circumferential wall 13 and the fan 3 in the radial direction is set to be the shortest in this tongue part 16, the inflow of air from the end of winding to the beginning of winding of the spiral flow passage 19 is suppressed. This results in eliminating a reduction in air supply volume due to flowing of a large volume of air between the winding end side and winding beginning side and an increase in specific sound level.

Here, since air flowing in from the bell mouth 27 of the suction port 11 flows toward the bottom plate 6 of the blades 8 of the fan 3 and is concentrated thereon, the flow rate of air flowing out from the fan 3 tends to be higher on the side of the second end wall 22 than on the side of the first end wall 21. However, the flow rate of air flowing out from the fan 3 has a circumferential component and a radial component, and among them, the circumferential component tends to be high on the side of the first end wall 21 and low on the side of the second end wall 22. On the other hand, the radial component is high on the side of the second end wall 22 and low on the side of the first end wall 21.

In this situation, although a secondary flow from the second end wall 22 toward the first end wall 21 along the outer circumferential wall 13 is generated in the spiral flow passage 19 inside the scroll casing 4, since the first end wall 21 of the scroll casing 4 is inclined to increase the flow passage cross-section area of the spiral flow passage 19 gradually from the upstream toward the downstream as in the embodiment, the rate of flow in the spiral flow passage 19 in the circumferential direction of the fan 3 is suppressed on the side of the first end wall 21. This causes the rate of flow to be substantially equal between the side of the first end wall 21 and the side of the second end wall 22, and hence the secondary flow from the second end wall 22 toward the first end wall 21 to be suppressed. This stabilizes the flow in the axial direction of the spiral flow passage 19 (axial direction of the rotating shaft 7) and reduces noise, improving efficiency. The measurement results showed that the amount of decrease in specific sound level in the case of the scroll casing 4 having such a shape was −1.0 dB.

(Shape of Tongue Part 16)

Figure 5:
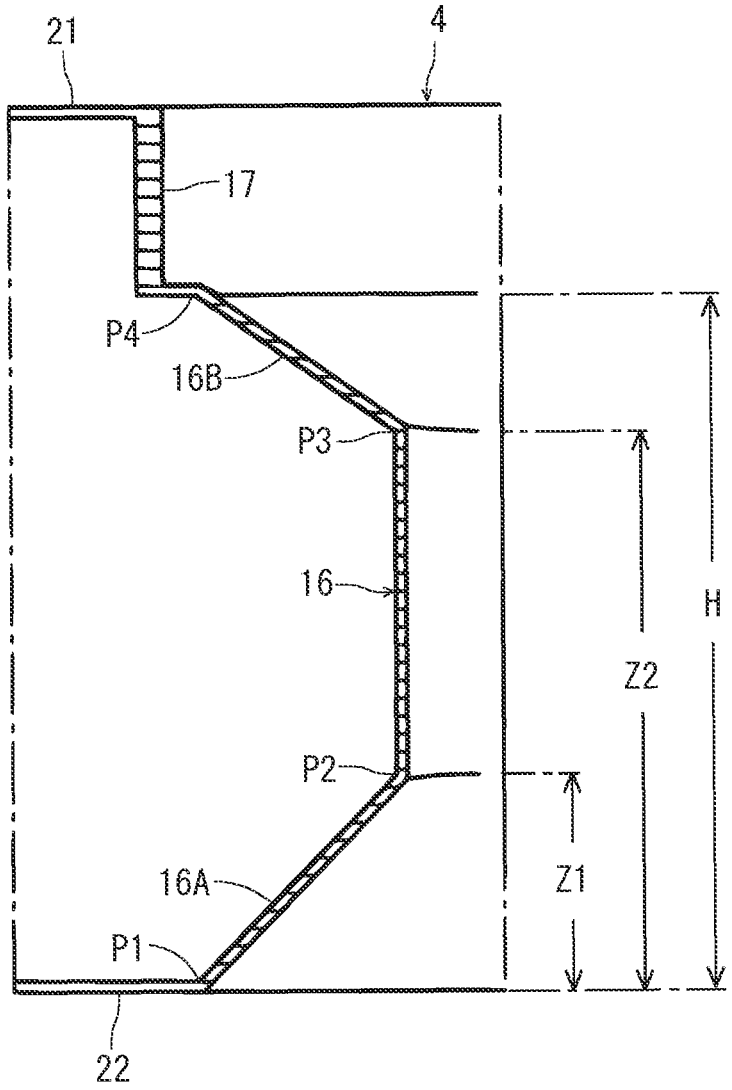
FIG. 5 It is an A-A line sectional view of FIG. 4.
Figure 6:
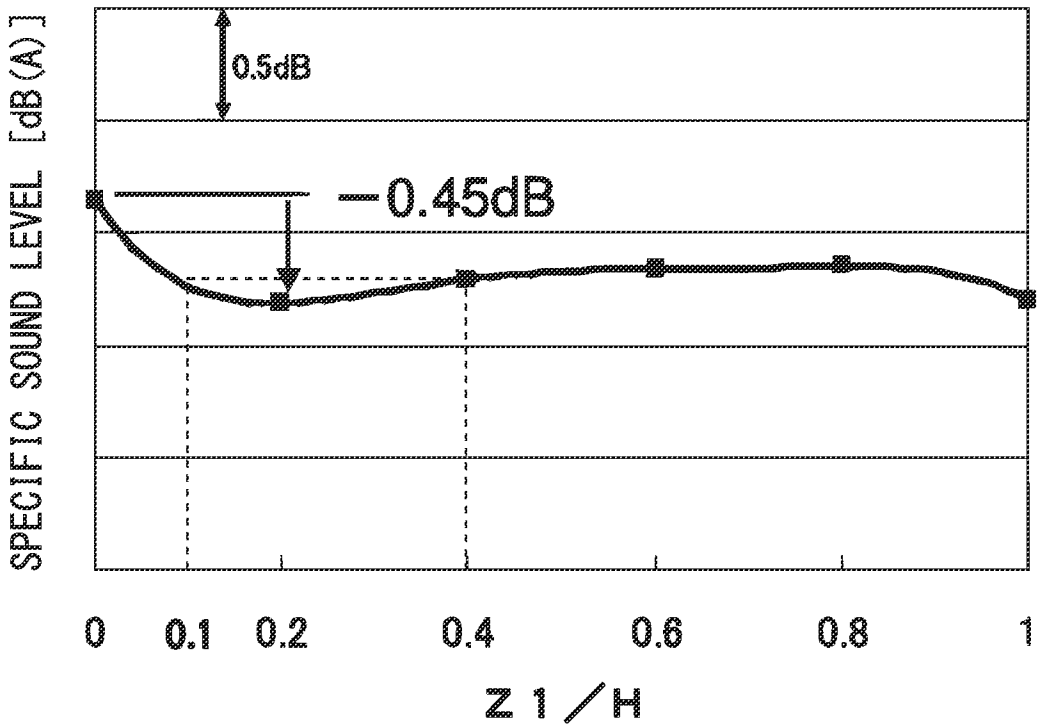
FIG. 6 It is a chart as a result of measuring the relationship between Z1/H and specific sound level when a dimension of the tongue part in the axial direction of the rotating shaft is denoted by H, and a dimension in the axial direction of the rotating shaft from an end of the tongue part on the other end side in the axial direction of the rotating shaft to a point of starting overhanging on the other end side in the axial direction of the rotating shaft is denoted by Z1.
Figure 7:
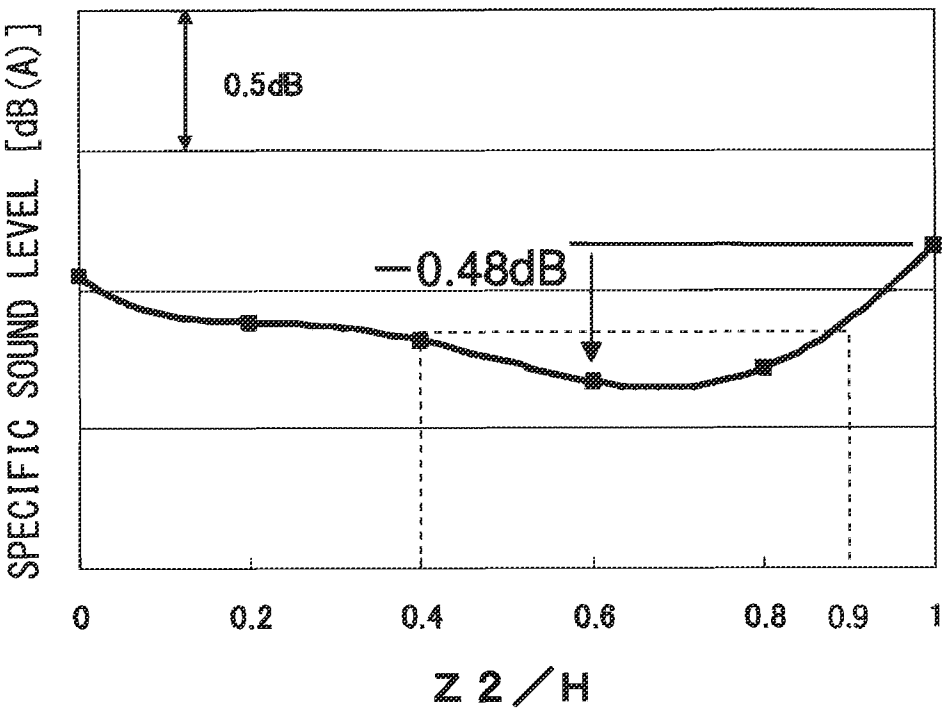
FIG. 7 It is a chart as a result of measuring the relationship between Z2/H and specific sound level when a dimension in the axial direction of the rotating shaft from an end of the tongue part on the other end side in the axial direction of the rotating shaft to a point of starting overhanging on one end side in the axial direction of the rotating shaft is denoted by Z2.
Figure 8:
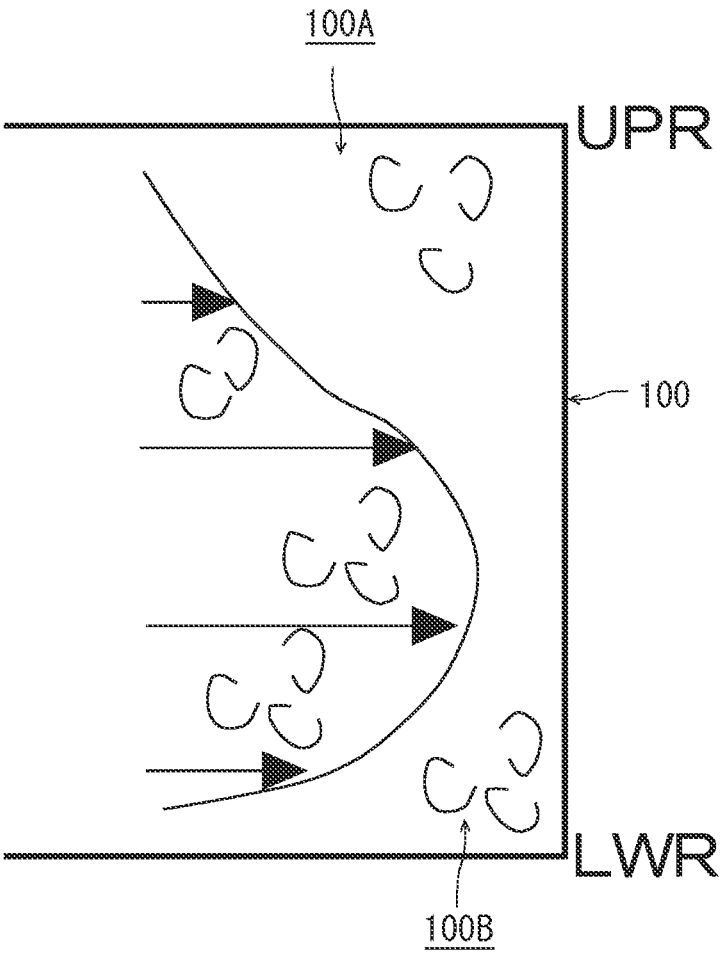
FIG. 8 It is a schematic diagram showing flows of air from a fan and stagnant areas when the front edge of a tongue part is parallel to the rotating shaft.
Figure 9:
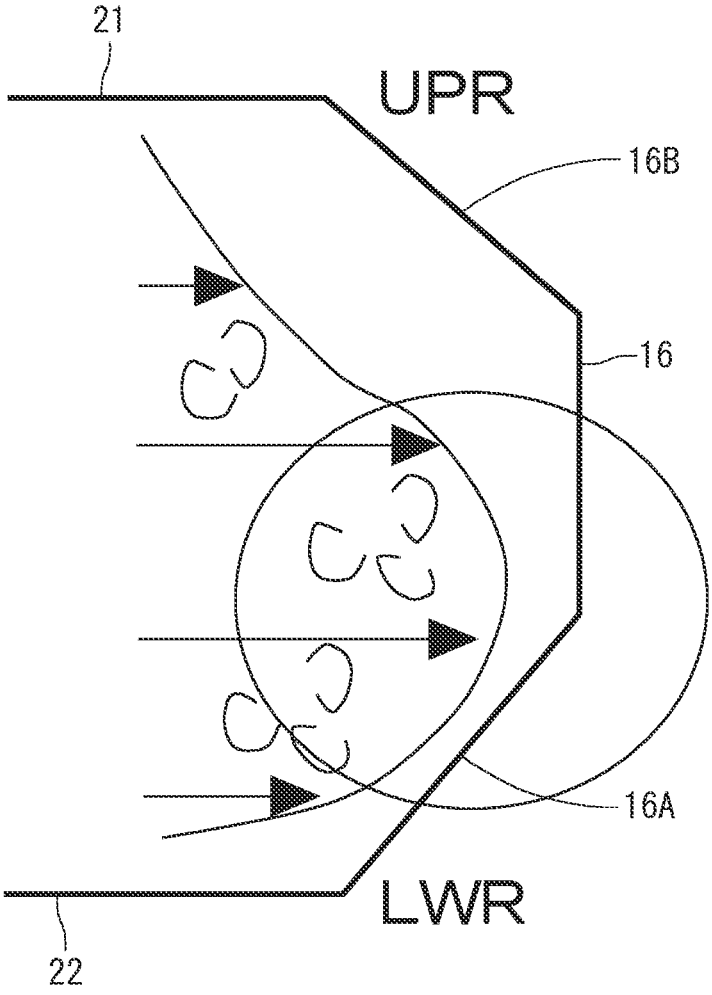
FIG. 9 It is a schematic diagram showing flows of air from the fan when portions of the tongue part on the other end side and one end side in the axial direction of the rotating shaft are inclined, respectively, to increase dimensions of overhanging in a counter-rotating direction of the fan toward the other end side and the one end side.

Referring next to FIG. 5 to FIG. 9, the shape of the tongue part 16 of the scroll casing 4 in the embodiment will be described. The inventor verified the shape to reduce noise in the tongue part 16. FIG. 5 shows an A-A line sectional view of FIG. 4, and FIG. 6 and FIG. 7 show the verification results. Further, FIG. 9 is a schematic diagram for describing the verification results.

As mentioned above, the velocity distribution of air flowing out from the fan 3 shows that velocity on the side of the electric motor 2 (the side of the bottom plate 6 indicated by LWR in FIG. 8 and FIG. 9) is higher. Since many vortices are contained in the air flowing out from the fan 3, noise is generated when the vortices collide with the tongue part 16. Further, when the front edge is that of the normal tongue part 100 parallel to the rotating shaft 7 of the electric motor 2 as shown in FIG. 8, stagnant areas are formed in a corner 100A on the suction port side of the tongue part 100 (indicated by UPR in FIG. 8) and a corner 100B on the side of the electric motor 2 (LWR). Therefore, since shear turbulence due to interference between a flow of air flowing out from the fan 3 and the stagnant areas, and noise due to a secondary flow are produced, noise caused by the tongue part 16 in conjunction with the noise due to the vortices mentioned above increases as a whole.

Therefore, a first overhanging section 16A inclined to increase the overhanging dimension in a counter-rotating direction of the fan 3 (a counterclockwise direction in FIG. 4) toward the side of the second end wall 22 was first formed in a portion of the tongue part 16 on the side of the second end wall 22 (on the other end side in the axial direction of the rotating shaft 7). Then, a specific sound level when the shape of this first overhanging section 16A is changed was measured. Upon changing the shape, a dimension of the tongue part 16 in the axial direction of the rotating shaft 7 (i.e., the overall dimension of the tongue part 16 in the axial direction of the rotating shaft 7) was denoted by H, and a dimension of the tongue part 16 in the axial direction of the rotating shaft 7 from an end P1 on the side of the second end wall 22 (on the other end side in the axial direction of the rotating shaft 7) to a point P2 of starting overhanging on the side of the second end wall 22 was denoted by Z1 (i.e., the dimension of the first overhanging section 16A in the axial direction of the rotating shaft 7) as shown in FIG. 5.

Then, a change in specific sound level when a ratio Z1/H of the dimension Z1 of the first overhanging section 16A in the axial direction of the rotating shaft 7 to the overall dimension H of the tongue part 16 in the axial direction of the rotating shaft 7 is changed was measured. The results are shown in FIG. 6. It was found that, although the specific sound level was decreased compared to the case of Z1/H=0 because the formation of the first overhanging section 16A makes the stagnant area (100B in FIG. 8) in the corner on the side of the electric motor 2 indicated by LWR in FIG. 9 disappear, it became particularly good in a range of not less than 0.1 and not more than 0.4 ($0.1 \leq Z1/H \leq 0.4$), and became −0.45 dB as the lowest when Z1/H=0.2. Therefore, Z1/H is set to 0.2 in the present invention.

Next, a second overhanging section 16B inclined to increase the overhanging dimension in the counter-rotating direction of the fan 3 (the counterclockwise direction in FIG. 4) toward the side of the first end wall 21 was formed in a portion of the tongue part 16 on the side of the first end wall 21 (on one end side in the axial direction of the rotating shaft 7) without forming the first overhanging section 16A. Then, a specific sound level when the shape of this second overhanging section 16B is changed was measured in the same manner. Upon changing the shape, a dimension of the tongue part 16 in the axial direction of the rotating shaft 7 from the end P1 on the side of the second end wall 22 (on the other end side in the axial direction of the rotating shaft 7) to a point P3 of starting overhanging on the side of the first end wall 21 (i.e., the overall dimension of the tongue part 16 in the axial direction of the rotating shaft 7—the dimension of the second overhanging section 16B in the axial direction of the rotating shaft 7) was denoted by Z2 as shown in FIG. 5.

Then, a change in specific sound level when a ratio Z2/H of Z2 (the overall dimension of the tongue part 16 in the axial direction of the rotating shaft 7—the dimension of the second overhanging section 16B in the axial direction of the rotating shaft 7) to the overall dimension H of the tongue part 16 in the axial direction of the rotating shaft 7 mentioned above is changed was measured. The results are shown in FIG. 7. It was found that, although the specific sound level was decreased compared to the case of Z2/H=1 because the formation of the second overhanging section 16B makes the stagnant area (100A in FIG. 8) in the corner on the side of the suction port 11 indicated by UPR in FIG. 9 disappear, it became particularly good in a range of not less than 0.4 and not more than 0.9 ($0.4 \leq Z2/H \leq 0.9$), and became −0.48 dB as the lowest when Z2/H=0.6. Therefore, Z2/H is set to 0.6 in the present invention.

Then, both the first overhanging section 16A and the second overhanging section 16B mentioned above were formed in the tongue part 16 as in the embodiment shown in FIG. 5. It was found that, when the dimensional ratios Z1/H and Z2/H mentioned above are set to the best values, i.e., when Z1/H=0.2 and Z2/H=0.6, the amount of decrease in specific sound level became −0.52 dB as the largest amount of decrease. This is because the formation of the first and second overhanging sections 16A and 16B make both of the stagnant areas 100A and 100B shown in FIG. 8 disappear as shown in FIG. 9.

Note that the end P1 of the tongue part 16 and an end (indicated by P4) on the side of the suction port 11, and the points P2 and P3, from which each overhanging section 16A, 16B starts overhanging, shown in FIG. 5 become corner portions though they are obtuse angles. Although there is fear that air collides with the corner portions to produce turbulence, if the corners formed at these points P1 to P4 are connected in a smoothly curved manner, turbulence caused when air collides with these portions can be suppressed, achieving a further noise reduction.

(Shapes of Upright Wall 26 and Bell Mouth 27)

Figure 10:
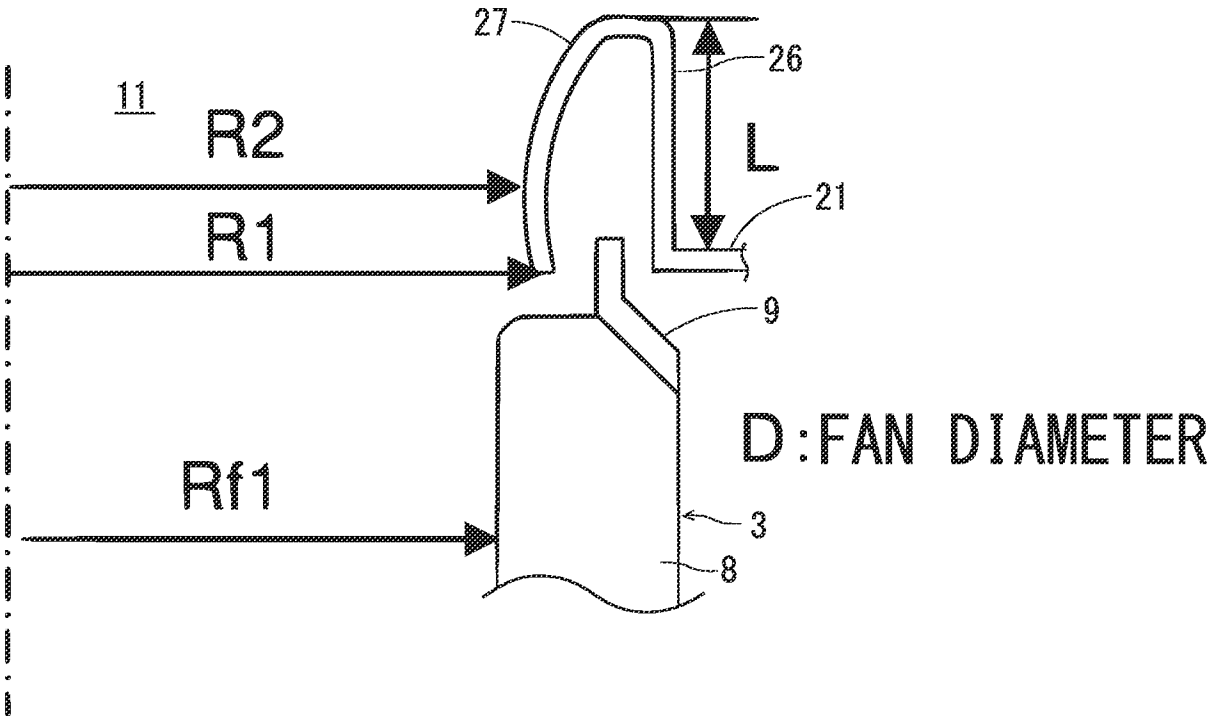
FIG. 10 It is an enlarged, longitudinal sectional side view of a suction port of the centrifugal air blower in FIG. 1.
Figure 11:
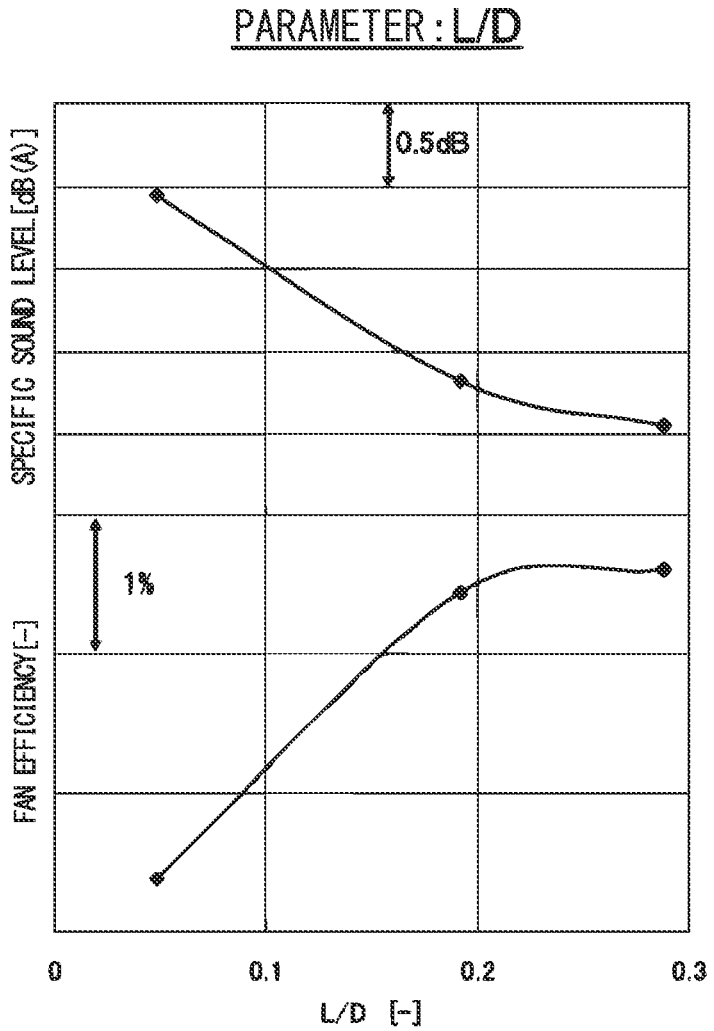
FIG. 11 It is a chart as a result of measuring the relationship among L/D, specific sound level, and fan efficiency when the diameter of the fan is denoted by D, and a standing dimension of an upright wall around the suction port is denoted by L.
Figure 12:
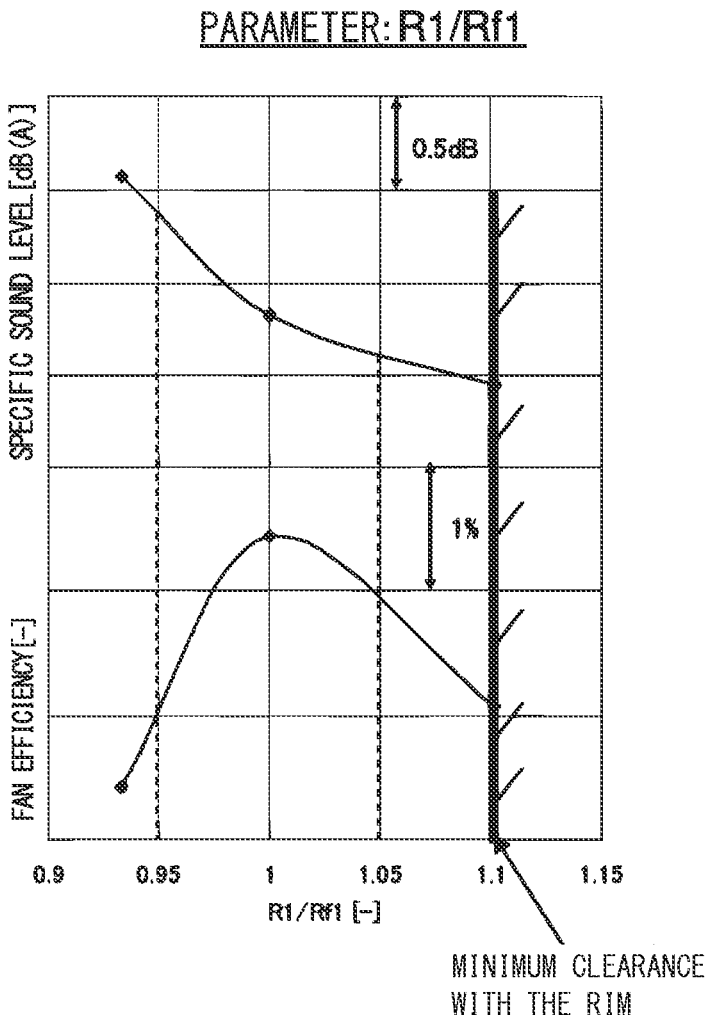
FIG. 12 It is a chart as a result of measuring the relationship among R1/Rf1, specific sound level, and fan efficiency when a dimension from the axial center of the rotating shaft to inner ends of the blades is denoted by Rf1, and a dimension from the axial center of the rotating shaft to a front edge of a surface of the upright wall on the suction port side is denoted by R1.
Figure 13:
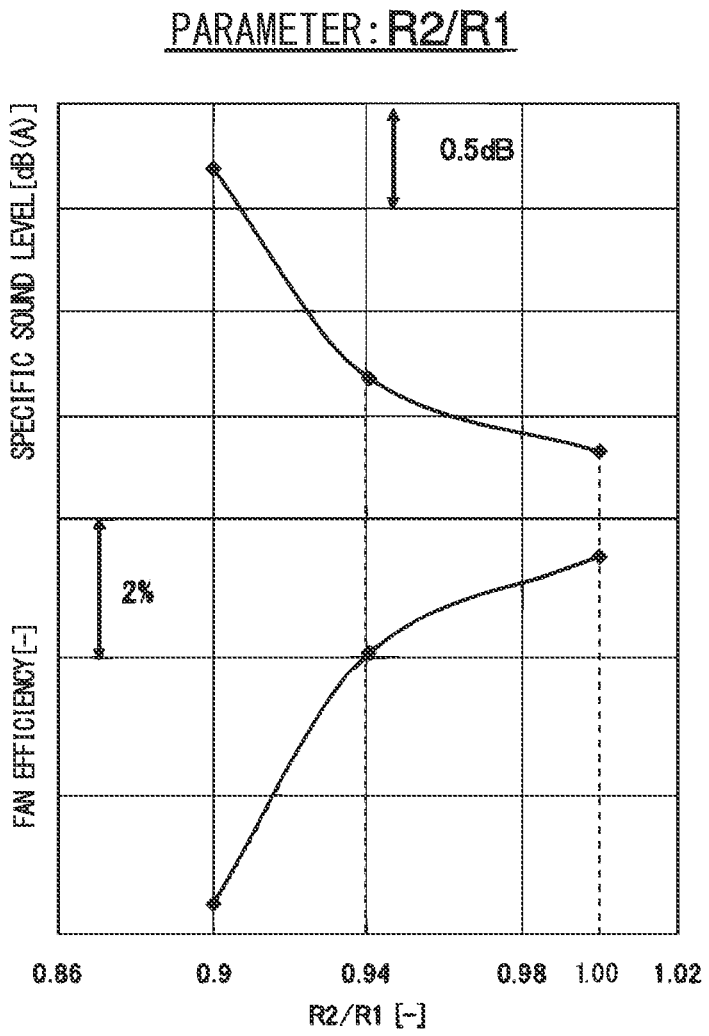
FIG. 13 It is a chart as a result of measuring the relationship among R2/R1, specific sound level, and fan efficiency when a dimension from the axial center of the rotating shaft to an inner edge of the surface of the upright wall on the suction port side is denoted by R2.
Figure 14:
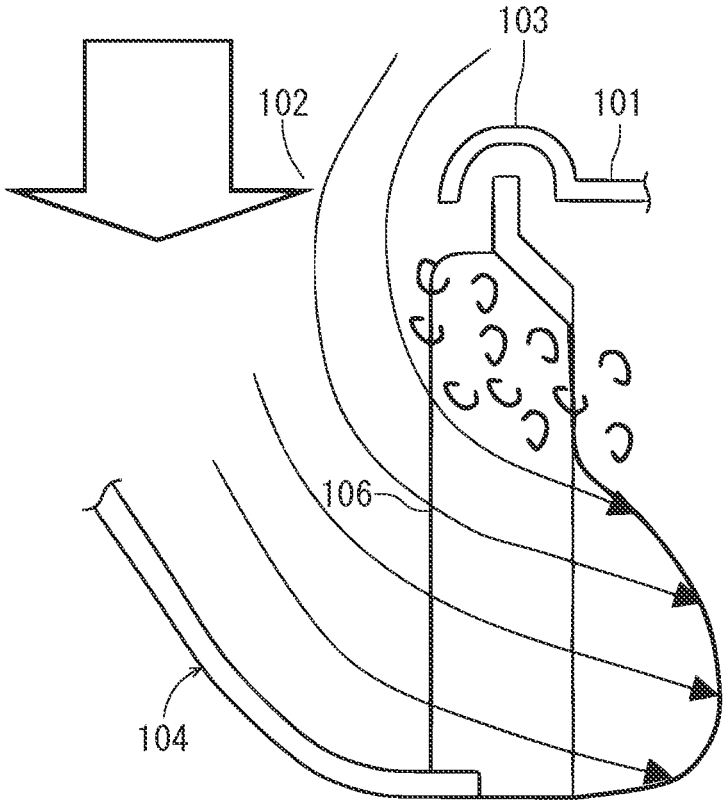
FIG. 14 It is a schematic diagram of a normal bell-mouth shaped suction port showing a flow of air flowing from the suction port into the fan.
Figure 15:
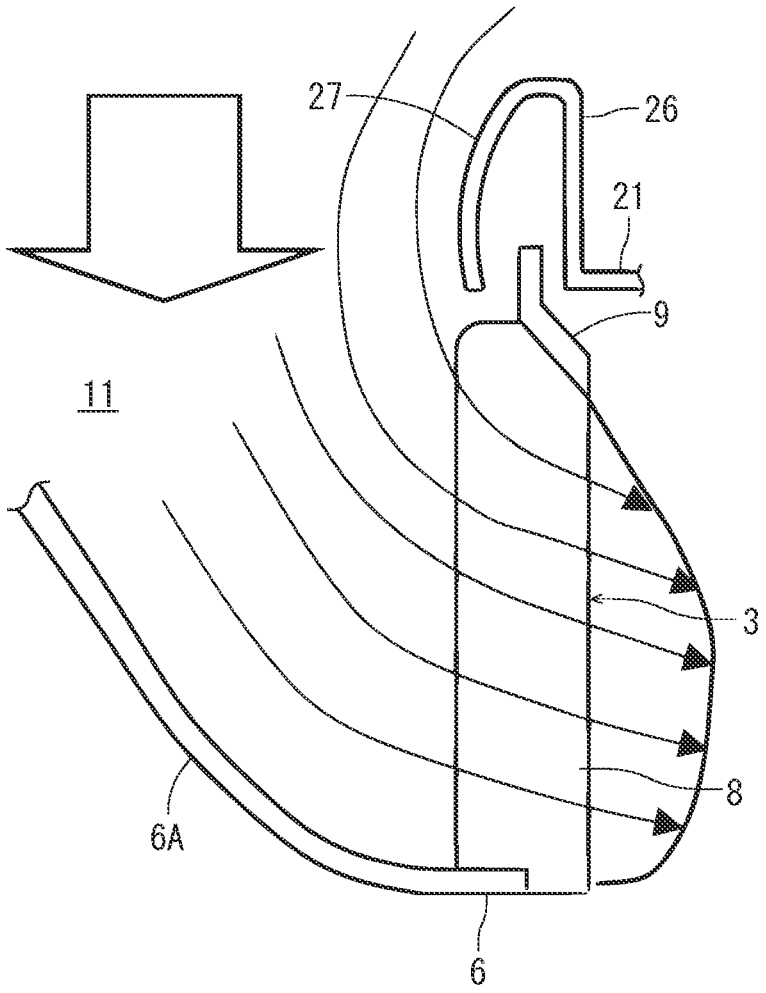
FIG. 15 It is a schematic diagram of a suction port showing a flow of air flowing from the suction port into the fan when an upright wall is formed therearound and a surface of the upright wall on the suction port side is formed in a bell-mouth shape.

Referring Next to FIG. 10 to FIG. 15, the Shapes of the upright wall 26 and the bell mouth 27 of the scroll casing 4 in the embodiment will be described. The inventor verified whether noise caused when air flows into the fan 3 can be reduced by the shapes of the upright wall 26 and the bell mouth 27. FIG. 10 is an enlarged longitudinal sectional side view of part of the suction port 11 of the scroll casing 4, and FIG. 11 to FIG. 13 show the verification results. FIG. 15 is a schematic diagram for describing the verification results.

As mentioned above, a flow of air flowing in from the suction port 11 inside the bell mouth 27 by the rotation of the fan 3 flows toward the base side of the blades 8 (the side of the bottom plate 6 on which the electric motor 2 is present) and is concentrated thereon. In the case of a normal bell mouth as shown in FIG. 14, there is little flow into the blades 8 on the side of the suction port 11 due to separation at the front edge of the bell mouth, becoming a stagnant state. This causes the flow of air concentrated on the base side of the blades 8 to have a high flow-rate distribution locally, resulting in a noise increase proportional to the sixth power of the flow rate of air.

Therefore, the upright wall 26 as in the embodiment was first formed around the suction port 11, and the specific sound level and the fan efficiency were measured while changing a height dimension L. FIG. 11 is a chart showing the results. Here, L denotes a dimension by which the upright wall 26 stands from the first end wall 21, and D denotes the diameter of the fan 3 (the dimension of a line extending between outer ends of the blades 8 through the axial center of the boss part 6B), and changes in specific sound level and fan efficiency when a ratio L/D of the standing dimension L of the upright wall 26 to the fan diameter D were measured.

As apparent from FIG. 11, it was found that the specific sound level is reduced as L/D increases in an L/D range of 0 to 0.3 to improve the fan efficiency. Particularly, the specific sound level had a reduction effect of −1.6 dB in the measurement range. It is considered that this is because the higher the upright wall 26, the greater the curved vertical dimension of the bell mouth 27, and hence air flowing in from the suction port 11 flows along the bell mouth 27 by the Coanda effect to allow easy flowing into the blades 8 of the fan 3 on the side of the suction port 11 (on the side of the first end wall 21) as shown in FIG. 15.

In other words, it is considered that the flow rate of air is made uniform between blades 8 in the longitudinal direction of the blades 8 (the axial direction of the rotating shaft 7) to eliminate areas in which velocity becomes locally high so as to reduce noise. Although it is better to increase L/D, it goes without saying that there is a limit because of leading to an increase in the dimensions of the centrifugal air blower 1 itself if the standing dimension L of the upright wall 26 is too large.

Thus, it was found that the bell mouth 27 when the upright wall 26 is formed in a standing shape is effective. Next, the shape of the bell mouth 27 itself was verified. As factors in this case, a dimension (an inner dimension of the fan 3) Rf1 from the axial center of the rotating shaft 7 to an inner end of each blade 8, a dimension (an inner dimension of the front edge of the bell mouth 27) R1 from the axial center of the rotating shaft 7 to the front edge (an edge on the side of the fan 3) of the bell mouth 27 (a surface of the upright wall 26 on the side of the suction port 11), and a dimension (the minimum inner dimension of the bell mouth 27) R2 from the axial center of the rotating shaft 7 to an inner edge of the bell mouth 27 were adopted.

Then, the specific sound level and the fan efficiency were measured when a ratio R1/Rf1 of the inner dimension R1 of the front edge of the bell mouth 27 to the inner dimension Rf1 of the fan 3 mentioned above is changed. The results are shown in FIG. 12. In this chart, a vertical line of R1/Rf1=1.1 indicated by the heavy line indicates a limiting point with the minimum clearance with the rim 9, and it must be set to this value or smaller because interference between the bell mouth 27 and the rim 9 will occur if R1 takes a larger value than that.

As apparent from this chart, the specific sound level is reduced as R1/Rf1 increases. However, the fan efficiency tends to increase up to R1/Rf1=1 and decreases after that. It is considered that this is because the amount of air leakage from the clearance between the front edge of the bell mouth 27 and the blade 8 to the outside of the rim 9 among amounts of air flowing along the bell mouth 27 will increase if R1 becomes larger than Rf1. Therefore, it was found that it is better to set R1/Rf1 in a range of not more than 0.95, where the specific sound level is not too high, and not less than 1.05, where the fan efficiency does not decrease too much ($0.95 \leq R1/Rf1 \leq 1.05$). In the embodiment, R1/Rf1=1 is set, where the fan efficiency becomes the best.

Next, the specific sound level and the fan efficiency were measured when a ratio R2/R1 of the minimum inner dimension R2 of the bell mouth 27 to the inner dimension R1 of the front edge of the bell mouth 27 mentioned above is changed. The results are shown in FIG. 13. It is found from this chart that both the specific sound level and the fan efficiency tend to be reduced as R2/R1 increases when R2/R1 falls within a range of 0.9 to 1, and it is better to set R2/R1 in a range of not less than 0.94 and not more than 1 ($0.94 \leq R2/R1 \leq 1$) within the range. Therefore, R2/R1=1 is set in the embodiment. It is considered that this is because, if R2/R1 becomes larger than 1, a curved surface located before the front edge of the bell mouth 27 will come to the outside and such an unusual shape will cause air turbulence.

According to the structure described in detail above, the specific sound level was reduced by 1.92 dB by means of the upright wall 26 and the bell mouth 27 in the embodiment, compared to the specific sound level in a normal centrifugal air blower (FIG. 8 and FIG. 14). In addition to this, when the height of the first end wall 21 in the axial direction of the rotating shaft 7 was gradually increased from the beginning of winding of the spiral flow passage 19 toward the blowing outlet 12, the specific sound level was reduced by 2.89 dB compared to the normal centrifugal air blower. In addition to these, it was confirmed that, when the shape of the tongue part 16 was made to have a shape like in the embodiment, the specific sound level was reduced by 3.13 dB compared to the normal centrifugal air blower.

DESCRIPTION OF REFERENCE NUMERALS

1 centrifugal air blower
2 electric motor
3 fan
4 scroll casing
6 bottom plate
7 rotating shaft
8 blade
9 rim
11 suction port
12 blowing outlet
16 tongue part
16A first overhanging section
16B second overhanging section
19 spiral flow passage
21 first end wall
22 second end wall
26 upright wall
27 bell mouth

The invention claimed is:

1. A centrifugal air blower comprising:

a fan composed of a bottom plate fixed to a rotating shaft, a plurality of blades whose bases are fixed to an outer circumference of the bottom plate, and an annular rim provided concentrically with the bottom plate to couple distal ends of the blades;

a scroll casing for housing the fan and having a suction port on one end side in an axial direction of the rotating shaft;

a spiral flow passage formed around the fan in the scroll casing; and a tongue part for suppressing an inflow of air from end of winding to beginning of winding of the spiral flow passage, the tongue part comprising a linear portion that is substantially parallel to an axis of the rotating shaft, a first overhanging section formed on the one end side in the axial direction of the rotating shaft, and a second overhanging section formed on an other end side in the axial direction of the rotating shaft, wherein the first overhanging section is inclined to increase a first dimension of overhanging in the counter-rotating direction of the fan toward the one end side in the axial direction of the rotating shaft, and the second overhanging section is inclined to increase a dimension of overhanging in a counter-rotating direction of the fan toward the other end side in the axial direction of the rotating shaft;

characterized in that the first overhanging section forms a first obtuse angle with respect to the linear portion and the second overhanging section forms a second obtuse angle with respect to the linear portion; and wherein the first obtuse angle is different than the second obtuse angle.

2. The centrifugal air blower according to claim 1, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting the second overhanging section is denoted by Z1, $$0.1 \leq Z1/H \leq 0.4.$$

3. The centrifugal air blower according to claim 2, characterized in that Z1/H=0.2.

4. The centrifugal air blower according to claim 1, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting the first overhanging section on the one end side of the tongue part in the axial direction of the rotating shaft is denoted by Z2, $$0.4 \leq Z2/H \leq 0.9.$$

5. The centrifugal air blower according to claim 4, characterized in that Z2/H=0.6.

6. The centrifugal air blower according to claim 1, characterized in that corners of the ends of the tongue part and the points of starting the respective first and second overhanging sections are curved smoothly.

7. The centrifugal air blower according to claim 1, characterized in that an upright wall is formed around the suction port in the scroll casing, and a surface of the upright wall on a side of the suction port is curved in a bell mouth shape, and when a dimension from an axial center of the rotating shaft to inner ends of the blades is denoted by Rf1, a dimension from the axial center of the rotating shaft to a front edge of the surface of the upright wall on the side of the suction port is denoted by R1, and a dimension from the axial center of the rotating shaft to an inner edge of the surface of the upright wall on the side of the suction port is denoted by R2, $$0.95 \leq R1/Rf1 \leq 1.05,$$

and $$0.94 \leq R2/R1 \leq 1.$$

8. The centrifugal air blower according to claim 7, characterized in that R1/Rf1=1 and R2/R1=1.

9. The centrifugal air blower according to claim 1, wherein the first obtuse angle is less than the second obtuse angle.

10. The centrifugal air blower according to claim 1, characterized in that, when a dimension in the axial direction of the rotating shaft from an end of the tongue part on the other end side in the axial direction of the rotating shaft to a point of starting the second overhanging section is denoted by Z1, and a dimension in the axial direction of the rotating shaft from the point of starting the second overhanging section to a point of starting the first overhanging section on one end side of the tongue part in the axial direction of the rotating shaft is denoted by Z2−Z1, Z2−Z1 is greater than Z1.

11. The centrifugal air blower according to claim 1, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting the second overhanging section is denoted by Z1, and a dimension in the axial direction of the rotating shaft from the point of starting the second overhanging section to a point of starting the first overhanging section on one end side of the tongue part in the axial direction of the rotating shaft is denoted by Z2−Z1, Z2−Z1 is greater than H−Z2.

12. The centrifugal air blower according to claim 11, wherein Z2−Z1 is greater than Z1.

13. The centrifugal air blower according to claim 1, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting the second overhanging section is denoted by Z1, and a dimension in the axial direction of the rotating shaft from the point of starting the second overhanging section to a point of starting the first overhanging section on one end side of the tongue part in the axial direction of the rotating shaft is denoted by Z2−Z1, Z1 is greater than H−Z2.

14. The centrifugal air blower according to claim 13, wherein Z2−Z1 is greater than H−Z2.

15. The centrifugal air blower according to claim 1, characterized in that a section in a thickness direction of the tongue part has a predetermined curvature.

16. A centrifugal air blower, comprising:

a fan composed of a bottom plate fixed to a rotating shaft, a plurality of blades whose bases are fixed to an outer circumference of the bottom plate, and an annular rim provided concentrically with the bottom plate to couple distal ends of the blades;

a scroll casing for housing the fan and having a suction port on one end side in an axial direction of the rotating shaft;

a spiral flow passage formed around the fan in the scroll casing; and a tongue part for suppressing an inflow of air from end of winding to beginning of winding of the spiral flow passage, the tongue part comprising a linear portion, a first overhanging section formed on the one end side in the axial direction of the rotating shaft, and a second overhanging section formed on another end side in the axial direction of the rotating shaft, wherein the first overhanging section is inclined to increase a first dimension of overhanging in the counter-rotating direction of the fan toward the one end side in the axial direction of the rotating shaft, the second overhanging section is inclined to increase a dimension of overhanging in a counter-rotating direction of the fan toward the other end side in the axial direction of the rotating shaft, and the first overhanging section forms a first obtuse angle with respect to the linear portion and the second overhanging section forms a second obtuse angle with respect to the linear portion that is greater than the first obtuse angle.

17. The centrifugal air blower according to claim 16, characterized in that, when a dimension in the axial direction of the rotating shaft from an end of the tongue part on the other end side in the axial direction of the rotating shaft to a point of starting the second overhanging section is denoted by Z1, and a dimension in the axial direction of the rotating shaft from the point of starting the second overhanging section to a point of starting the first overhanging section on one end side of the tongue part in the axial direction of the rotating shaft is denoted by Z2−Z1, Z2−Z1 is greater than Z1.

18. The centrifugal air blower according to claim 17, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting the second overhanging section is denoted by Z1, and a dimension in the axial direction of the rotating shaft from the point of starting the second overhanging section to a point of starting the first overhanging section on one end side of the tongue part in the axial direction of the rotating shaft is denoted by Z2−Z1, Z2−Z1 is greater than H−Z2.

19. The centrifugal air blower according to claim 16, characterized in that, when a dimension of the tongue part in the axial direction of the rotating shaft is denoted by H, and a dimension in the axial direction of the rotating shaft from an end of the tongue part on the other end side in the axial direction of the rotating shaft to a point of starting the second overhanging section is denoted by Z1, $$0.1 \leq Z1/H \leq 0.4.$$

* * * * *